US006349564B1

(12) United States Patent
Lingelbach et al.

(10) Patent No.: US 6,349,564 B1
(45) Date of Patent: Feb. 26, 2002

(54) REFRIGERATION SYSTEM

(76) Inventors: Fredric J. Lingelbach; John F. Lingelbach, both of P.O. Box 609, Elkhorn, NE (US) 68022

( * ) Notice: Subject to any disclaimer, the term of this patent is extended or adjusted under 35 U.S.C. 154(b) by 0 days.

(21) Appl. No.: 09/659,315

(22) Filed: Sep. 12, 2000

(51) Int. Cl.[7] ..... F25B 1/10
(52) U.S. Cl. ..... 62/510; 62/509; 62/503
(58) Field of Search ..... 62/510, 503, 509, 62/175, 335; 236/1 EA

(56) References Cited

U.S. PATENT DOCUMENTS

| | | | | | |
|---|---|---|---|---|---|
| 2,693,683 | A | | 11/1954 | Toothman | 62/117.55 |
| 3,214,932 | A | | 11/1965 | Grant | 62/174 |
| 3,315,484 | A | | 4/1967 | Ross | 62/174 |
| 3,370,440 | A | | 2/1968 | Kellie | 62/503 |
| 3,636,723 | A | | 1/1972 | Kramer | 62/197 |
| 3,786,651 | A | | 1/1974 | Eschbaugh et al. | 62/222 |
| 3,817,046 | A | | 6/1974 | Aoki et al. | 62/40 |
| 3,866,427 | A | | 2/1975 | Rothmayer et al. | 62/7 |
| 3,919,859 | A | | 11/1975 | Ross | 62/503 |
| 3,986,362 | A | | 10/1976 | Baciu | 60/641 |
| 4,435,962 | A | * | 3/1984 | Mochizuki et al. | 62/175 |
| 4,858,681 | A | | 8/1989 | Sulzberger | 165/70 |
| 4,878,355 | A | | 11/1989 | Beckey et al. | 62/115 |
| 5,046,325 | A | * | 9/1991 | Kuwahara | 62/510 X |
| 5,056,328 | A | * | 10/1991 | Jaster et al. | 62/510 X |
| 5,171,592 | A | | 12/1992 | Holtzapple et al. | 426/69 |
| 5,189,885 | A | | 3/1993 | Ni | 62/117 |
| 5,235,820 | A | * | 8/1993 | Radermacher et al. | 62/510 X |
| 5,259,210 | A | | 11/1993 | Ohya et al. | 62/212 |
| 5,291,753 | A | | 3/1994 | Rockenfeller et al. | 62/480 |
| 5,355,692 | A | | 10/1994 | Brownfield | 62/212 |
| 5,386,700 | A | | 2/1995 | Hyde | 62/224 |
| 5,396,780 | A | | 3/1995 | Bendtsen | 62/212 |
| 5,435,149 | A | | 7/1995 | Strong et al. | 62/218 |
| 5,502,970 | A | | 4/1996 | Rajendran | 62/115 |
| 5,546,757 | A | | 8/1996 | Whipple, III | 62/225 |

* cited by examiner

*Primary Examiner*—Harry B. Tanner
(74) *Attorney, Agent, or Firm*—Mark Frederiksen

(57) ABSTRACT

The improved refrigeration system of the present invention includes an accumulator with a diffuser pipe extending downwardly into the upper end of a vapor refrigerant tank, the diffuser pipe extending from an evaporator and discharging vapor refrigerant therefrom into the tank. The diffuser pipe includes a lower end located within the interior of the tank which is expanded in diameter relative to the upper end, thereby reducing the velocity of fluid flowing through the pipe and entering the accumulator tank. A diffusion plate is mounted in the lower end of the diffuser pipe, to further diffuse fluid flowing therethrough. The improved refrigeration system also includes a tee having a stem portion extending horizontally from the condenser of the system, and a pair of upper and lower arms connected in a vertical orientation to the stem. The tee lower arm is connected to the receiver and the upper arm is connected to a purge connection. The improved refrigeration system further includes a two stage refrigeration system with the condenser of the high stage having a second section with a desuperheating coil therein to cool vapor refrigerant from the low stage compressor and supplying it to the high stage accumulator.

1 Claim, 9 Drawing Sheets

REFRIGERATION SYSTEM

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to industrial refrigeration systems, and more particularly to an improved dry suction ammonia refrigeration system having a desuperheating coil, a modified accumulator, and a specially shaped and located purge connection.

(2) Background Information

A major drawback of industrial and commercial refrigeration systems which utilize ammonia as a refrigerant is a high cost of installation, operation, and maintenance. Conventional two stage refrigeration systems utilize a first stage which will provide refrigerant gas having a pressure of about 15 inches HG-0 psig from a low stage accumulator to a compressor, which will compress the gas to approximately 25–30 psi and discharge the compressed gas to a desuperheating coil, then through an oil separator to the second stage. The second stage will take this pressurized gas through a second compressor which increases the pressure to approximately 185 psig. This high pressure gas is then run through a condenser.

The inventors herein have found that a reduction in the heat of the gas through a desuperheating coil prior to running the gas through a second compressor, reduces the horse power required to compress the gas in the second stage compressor, and also extends the life of the compressor. This in turn results in reduced maintenance, wear, and overall cost and efficiency of the refrigeration system.

BRIEF SUMMARY OF THE INVENTION

It is therefore a general object of the present invention to provide an improved ammonia refrigeration system.

A further object is to provide an improved ammonia refrigeration system which reduces operating costs, installation costs, and maintenance costs as compared to conventional ammonia refrigeration systems.

Another object of the present invention is to provide an improved ammonia refrigeration system with a desuperheating coil located and connected so as to reduce the horse power required to compress the gas in the system.

Yet another object is to provide a refrigeration system with an improved accumulator design.

Still another object of the present invention is to provide an improved refrigeration system with a tee purge connection located to permit purging of gas downstream of the condenser.

Yet a further object of the present invention is to provide an improved refrigeration system which reduces operating costs, installation costs, and maintenance costs as compared to conventional refrigeration systems.

These and other objects of the present invention will be apparent to those skilled in the art.

The improved refrigeration system of the present invention includes an accumulator with a diffuser and velocity reducer pipe extending downwardly into the upper end of a vapor refrigerant tank, the return pipe extending from an evaporator and discharging vapor refrigerant therefrom into the tank. The diffuser pipe includes a lower end located within the interior of the tank which is expanded in diameter relative to the upper end, thereby reducing the velocity of fluid flowing through the pipe and entering the accumulator tank. A diffusion plate is mounted in the diffuser pipe, to further diffuse fluid flowing therethrough.

The improved refrigeration system also includes a tee having a stem portion extending horizontally from the condenser of the system, and a pair of upper and lower arms connected in a vertical orientation to the stem. The tee lower arm is connected to the receiver and the upper arm is connected to a purge connection. This allows for a positive separation and accumulation of noncondensable gases.

The improved refrigeration system further includes a two stage refrigeration system with the condenser of the high stage having a second section with a desuperheating coil therein to cool vapor refrigerant from the low stage compressor and supplying it to the high stage accumulator.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
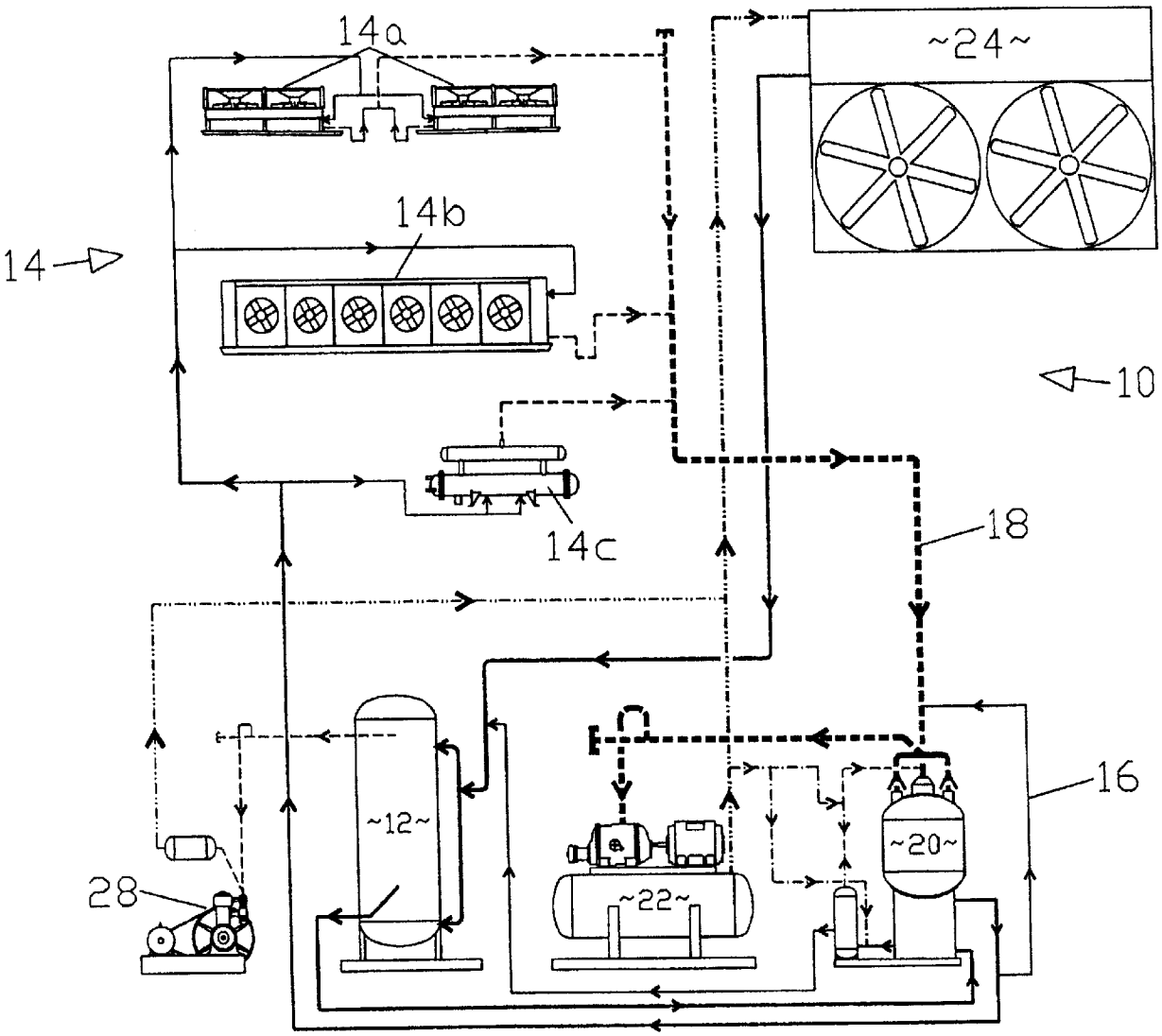
FIG. 1 is a detailed flow diagram of a single stage refrigeration system of the present invention.

Referring now to the drawings, and more particularly to FIG. 1, a dry suction ammonia refrigeration system is designated generally at 10, and a general flow diagram is schematically shown. Beginning at the control pressure receiver 12, liquid refrigerant, preferably ammonia, is pushed to evaporators designated generally at 14. The evaporators include processing units 14*a,* cooler units 14*b,* and a chiller 14*c.* Obviously, other types of uses are encompassed within the scope of this invention, although not detailed in this drawing. At each evaporator unit 14*a,* 14*b,* and 14*c,* the flow of liquid is completely evaporated to form a dry suction gas. In order to distinguish between the forms of the refrigerant, solid line 16 indicates refrigerant in a liquid form, and dashed line 18 shows refrigerant in a dry suction gas form. The dry suction gas is moved from the evaporators 14 to accumulator 20, where the gas is then drawn by a compressor 22. At the compressor, the refrigerant gas is compressed and pumped to condenser 24. Once condenser 24 transforms the gas back to a liquid, it is returned to receiver 12 for another cycle.

Figure 2:
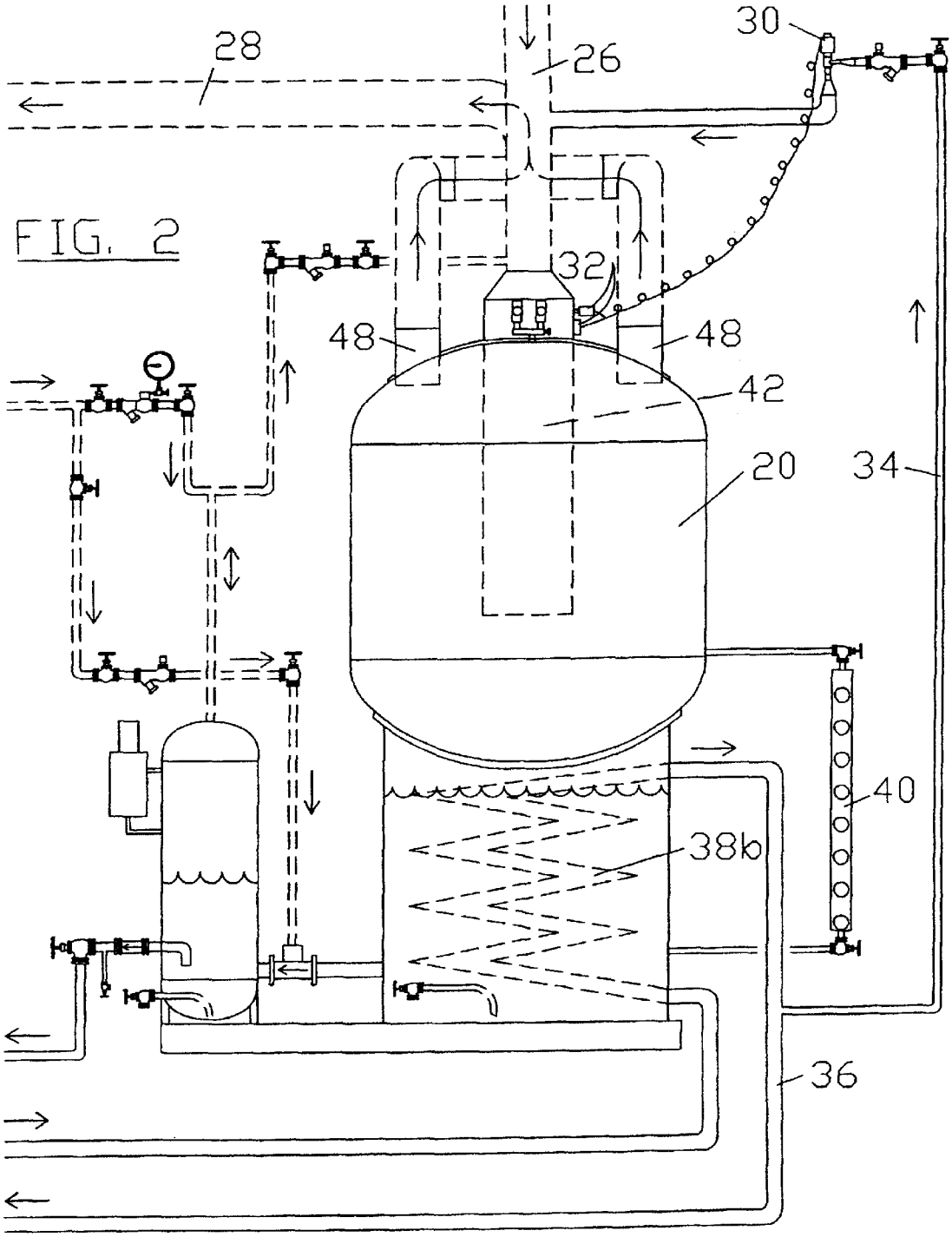
FIG. 2 is an enlarged schematic view of the accumulator of the system shown in FIG. 1.

Referring now to FIG. 2, the accumulator 20 of the present invention is shown in enlarged schematic form. Accumulator 20 is of a relatively radical design that is not used in standard systems. Suction gas coming back from the plant would enter via conduit 26, at a pressure of approximately 25–30 psi. Gas traveling to compressor 22 (shown in FIG. 1) would exit accumulator 20 via pipe 28.

An electronic expansion valve 30 is installed upstream of accumulator 20 along conduit 26, with probes 32 located to monitor the super heated gas entering accumulator 20. Expansion valve 30 is installed along a line 34 which is tapped into the conduit 36 carrying liquid from the controlled pressure receiver 12 to the evaporators 14. Expansion valve 30 is designed to protect the compressor 22 from overheating due to excessive super heated gas coming back from the plant. If the temperature of the super heated gas entering accumulator 20 becomes too high, the expansion valve 30 injects an amount of liquid refrigerant into the gas stream in conduit 26 to quench the excess heat.

Figure 3:
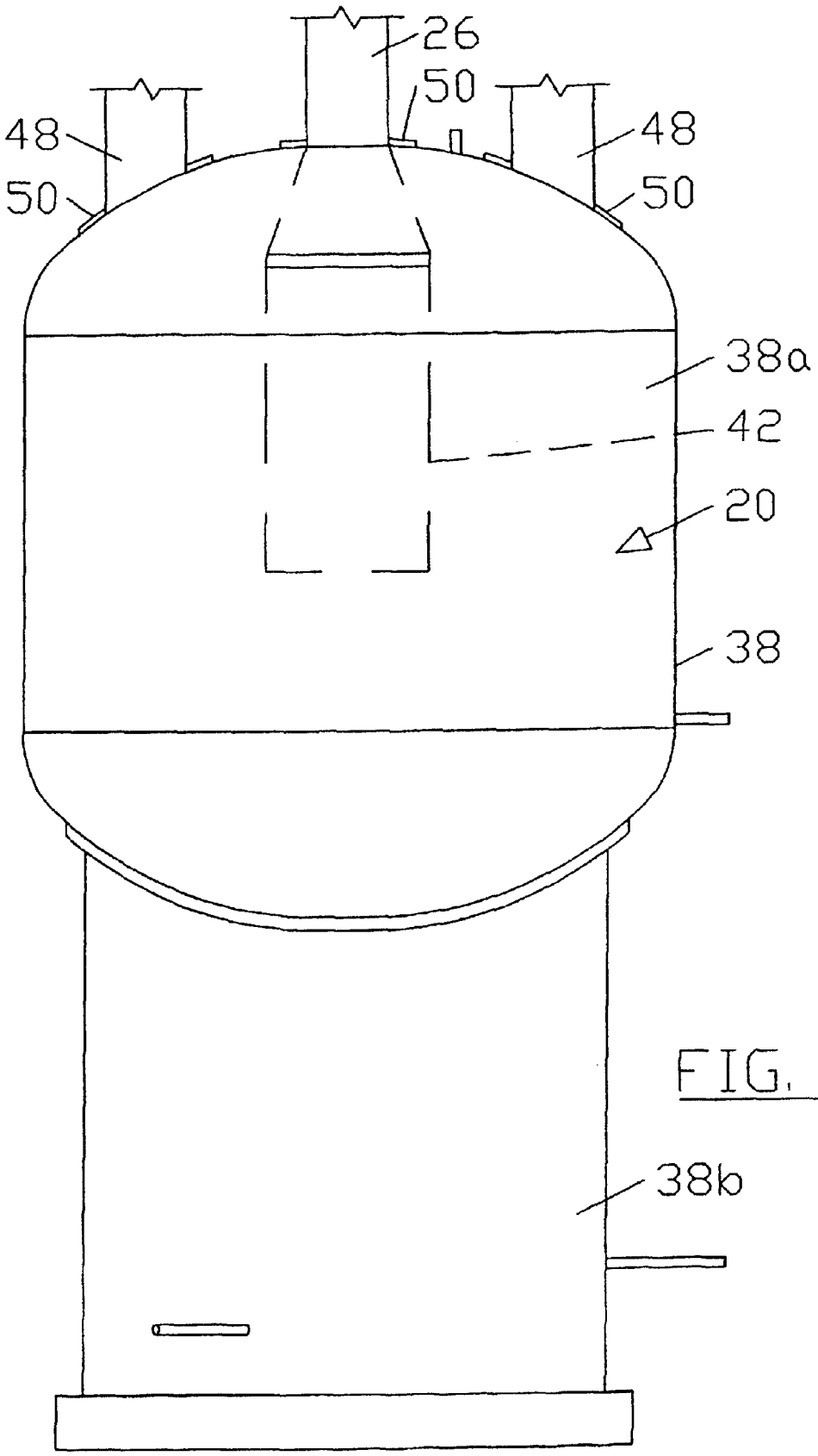
FIG. 3 is an enlarged elevational view of the accumulator shown in FIG. 2.

Referring now to FIG. 3, accumulator 20 is shown in more detail. The accumulator 20 includes a containment vessel 38 having an upper portion 38*a* and a lower portion 38*b*. As shown in FIG. 2, accumulator 20 is designed to accumulate any refrigerant in the form of liquid within lower portion 38*b* and includes a fluid level control apparatus 40 of a conventional type to maintain the liquid level within lower portion 38*b*. A diffuser pipe 42 enters the upper end of vessel upper portion 38*a* and has an upper end connected to conduit 26, to direct super heated gas into accumulator 20.

Figure 4:
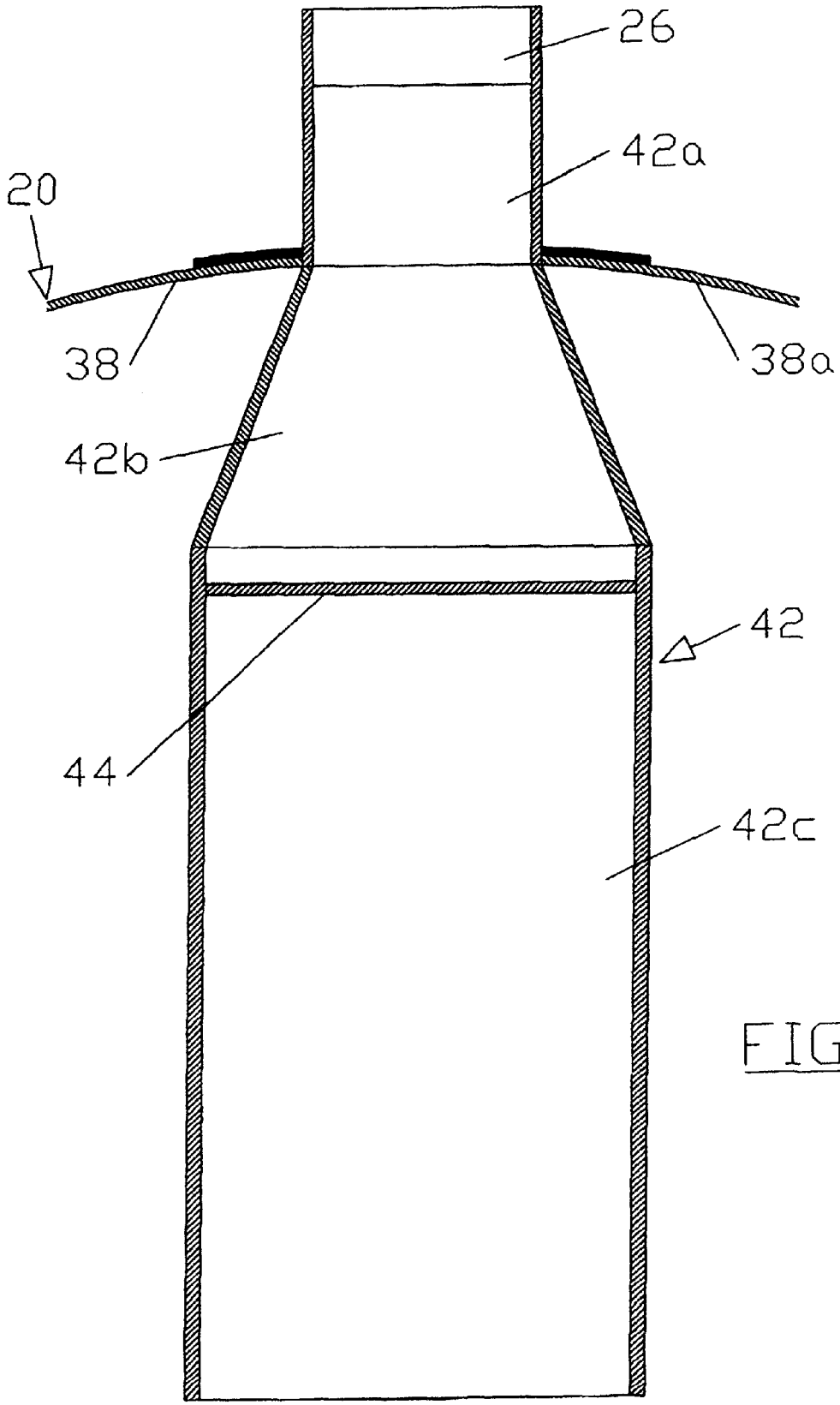
FIG. 4 is a super enlarged sectional view through the diffuser pipe of the accumulator shown in FIG. 3.

As shown in FIG. 4, diffuser pipe 42 includes an upper end 42*a* connected to conduit 26 and equal in diameter to conduit 26. Diffuser pipe includes a concentric reducer 42*b* downstream of upper portion 42*a*, which increases in diameter from its upper end to its lower end to approximately twice the diameter of upper portion 42*a* at its lower end. A lower portion 42*c* of diffuser pipe 42 extends vertically downward from the enlarged lower end of reducer 42*b*. Preferably, the lower end 42*c* of diffuser pipe 42 extends downward a distance approximately one-half the height of vessel upper portion 38*a*, but spaced above the liquid level in the vessel lower portion 38*b*, as shown in FIG. 3. This diffuser pipe length assists in diffusing the super heated gas and causing it to swirl about within the vessel, thereby causing any liquid within the gas to accumulate within the vessel lower portion 38*b*.

Referring once again to FIG. 4, reducer 42*b* will cause the velocity of refrigerant entering accumulator 20 from conduit 26 to reduce, because of the increase in diameter of the pipe from the upper portion 42*a* to the lower portion 42*c* in reducer 42*b*. This decrease in velocity also serves to diffuse the gas and assists in removing liquid from the gas.

Figure 5:
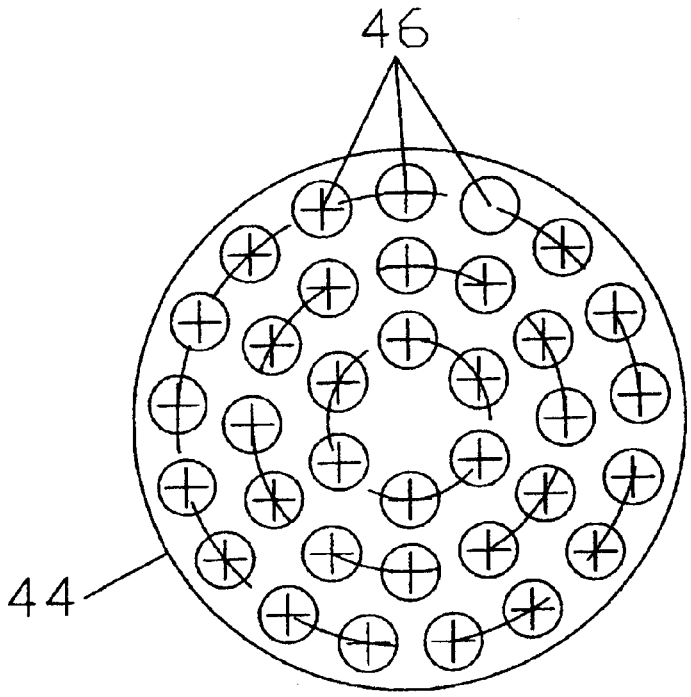
FIG. 5 is a plan view of the diffusion plate installed within the diffuser pipe shown in FIG. 4.

In order to assist in diffusion, diffusion plate 44 may be installed within the upper end of lower portion 42*c* of diffuser piper 42. Diffusion plate 44 includes a plurality of apertures 46, as shown in FIG. 5, with the area of apertures 46 being approximately 1.5 times the cross-sectional inside area of conduit 26 and/or diffuser pipe upper portion 42*a*. For example, if conduit 26 has a diameter of six inches, diffusion plate 44 should have apertures with a cross-sectional area equal to about 1.5 times the cross-sectional area (about 29 square inches) of conduit 26, equal to slightly more than 43 square inches. In addition, the side walls of each aperture 46 are preferably chamfered on the lower side, to function similar to reducer 42*b*, as refrigerant passes through each aperture 46.

Referring once again to FIG. 3, accumulator vessel upper portion 38*a* includes dual outlet pipes 48 extending vertically out of vessel upper portion 38*a* and thence connected together and to outlet pipe 28, as shown in FIG. 2. While dual outlet pipes 48 are shown in the drawings, dual outlets are not a requirement for the invention, and a single outlet pipe would function adequately. FIG. 3 additionally discloses reinforcing rings 50 mounted on vessel upper portion 38*a* around each of the outlet pipes 48 and the upper portion 42*a* of diffuser pipe 42 where it enters accumulator 20.

Figure 6:
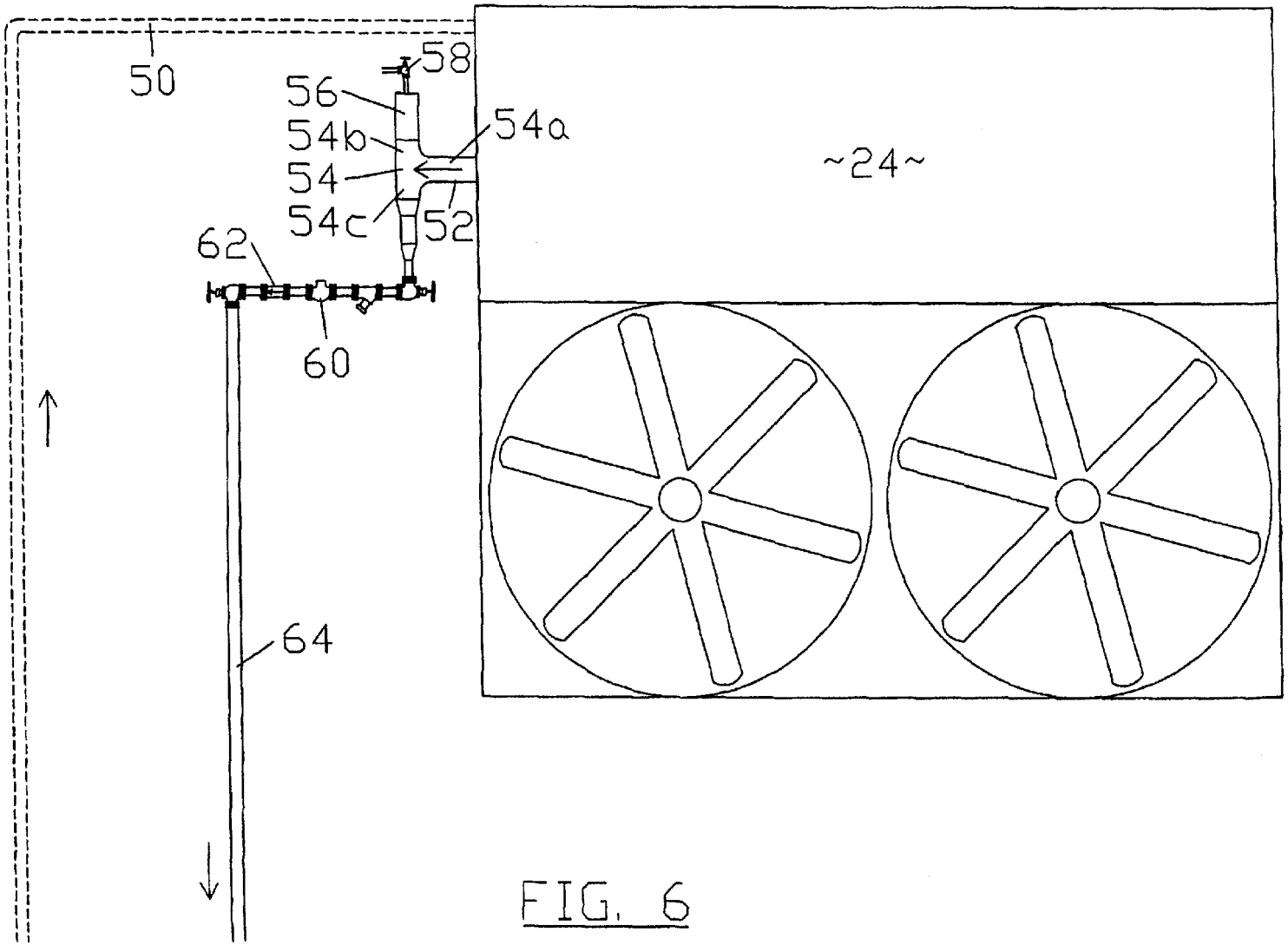
FIG. 6 is an enlarged schematic view of the condenser used in the system of FIG. 1.

Referring now to FIG. 6, the condenser 24 of the refrigeration system 10 is shown in enlarged schematic form. Condenser 24 is of conventional manufacture, but significant changes in the piping are used in the refrigeration system of this invention. Refrigerant in the form of gas having a pressure of approximately 110–185 psi is conveyed from compressor 28 (shown in FIG. 1) via inlet pipe 50, to condenser 24. The outlet pipe 52 is connected to the stem 54*a* of a full size tee 54 which is oriented with the stem 54*a* extending horizontally, and arms 54*b* and 54*c* extending vertically in opposing directions. The upper arm 54*b* of tee 54 has a full extension 56 of approximately 8–10 inches, which is capped. A purge valve 58 off of the cap of extension 56 is piped to a conventional purger. This feature allows a significant amount of noncondensable gases to accumulate and be purged. This improvement is necessary to remove noncondensable gases when condenser outlets are installed with mechanical traps. Once condenser 24 has condensed the refrigerant gas to liquid form, it exits the condenser through outlet pipe 52. The noncondensable gases will collect in tee upper arm 54*b* and extension 56 for purging, while the condensed liquid refrigerant continues through the tee lower arm 54*c*, thence through a trap 60, a check valve 62, and thence via pipe 64 to the receiver, at a pressure of approximately 55–60 psi.

Figure 7:
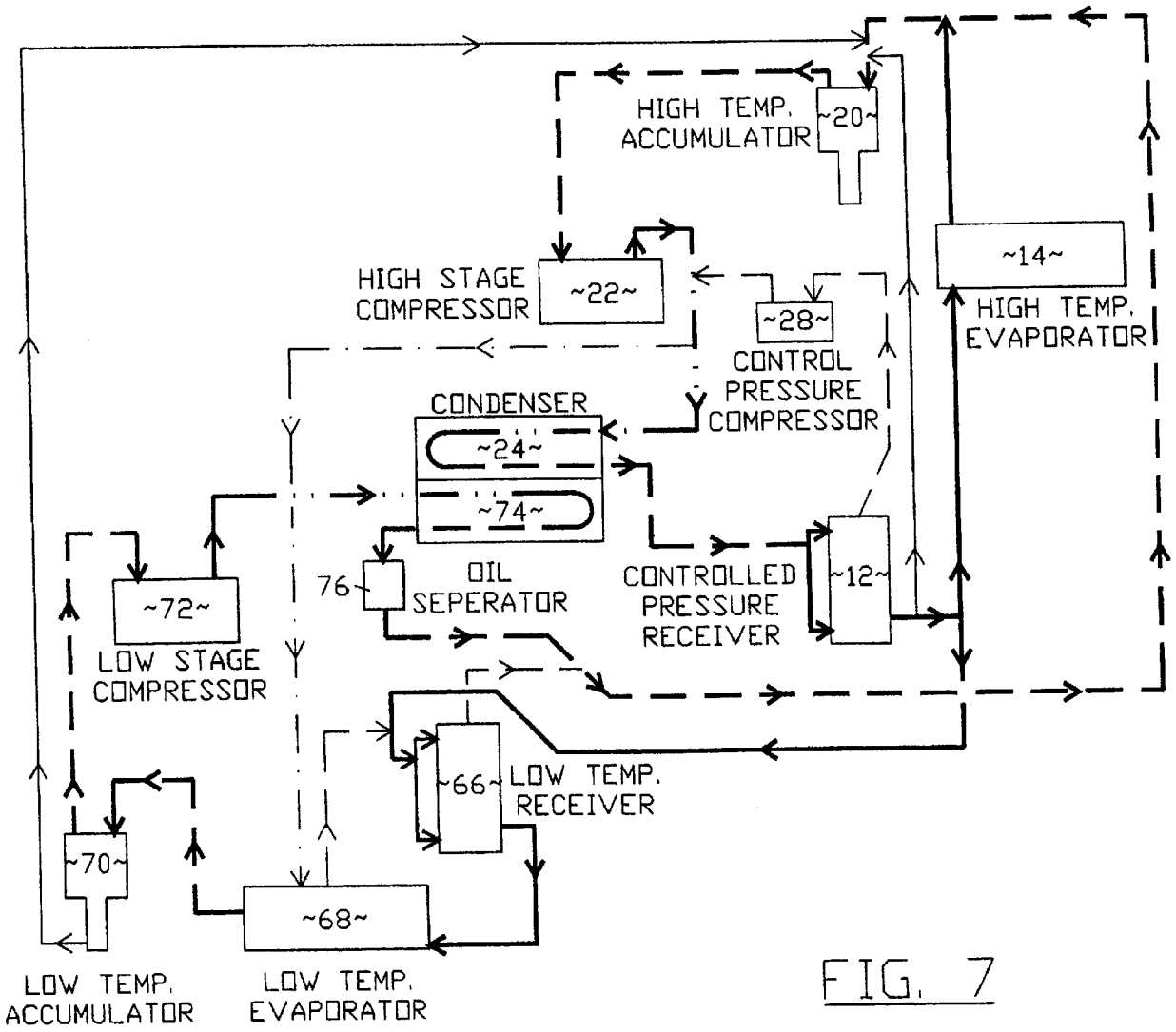
FIG. 7 is a block flow diagram of a two stage refrigeration system.

Referring now to FIG. 7, a two stage refrigeration system is shown in a block flow diagram, with a first stage having a lower pressure and lower temperature, and a second stage having a higher pressure and higher temperature. The high stage of the system of FIG. 7 is identical to the single stage version of the invention shown in FIG. 1, and for this reason all components will be identified with the same reference numerals. Starting once again at the controlled pressure receiver 12, liquid refrigerant is pushed to evaporators 14, wherein the refrigerant is completely evaporated to a dry suction gas. The dry suction gas is moved to the accumulator 20 where it is then drawn in by compressor 22. The refrigerant gas is compressed at compressor 22 and pumped to condenser 24 where the gas is condensed back to a liquid and flows back to the controlled pressure receiver 12.

Liquid refrigerant from control pressure receiver 12 is pushed through a pipe to the low stage receiver 66. The liquid refrigerant in low stage receiver 66 is pushed to the low temperature evaporator units 68, where the liquid is completely evaporated to form a dry suction gas. The dry suction gas from evaporators 68 is brought to the low stage accumulator 70 where the gas is then drawn by the low stage compressor 72. The gas is compressed in compressor 72, and pumped to a desuperheating coil 74 within the high stage condenser 24. After desuperheating the gas, the gas is brought back through an optional oil separator 76 to the high stage accumulator 20. Excess liquid in the low stage accumulator 70 is pushed through a pipe to the suction of the high stage accumulator 20 utilizing a transfer system.

Figure 8:
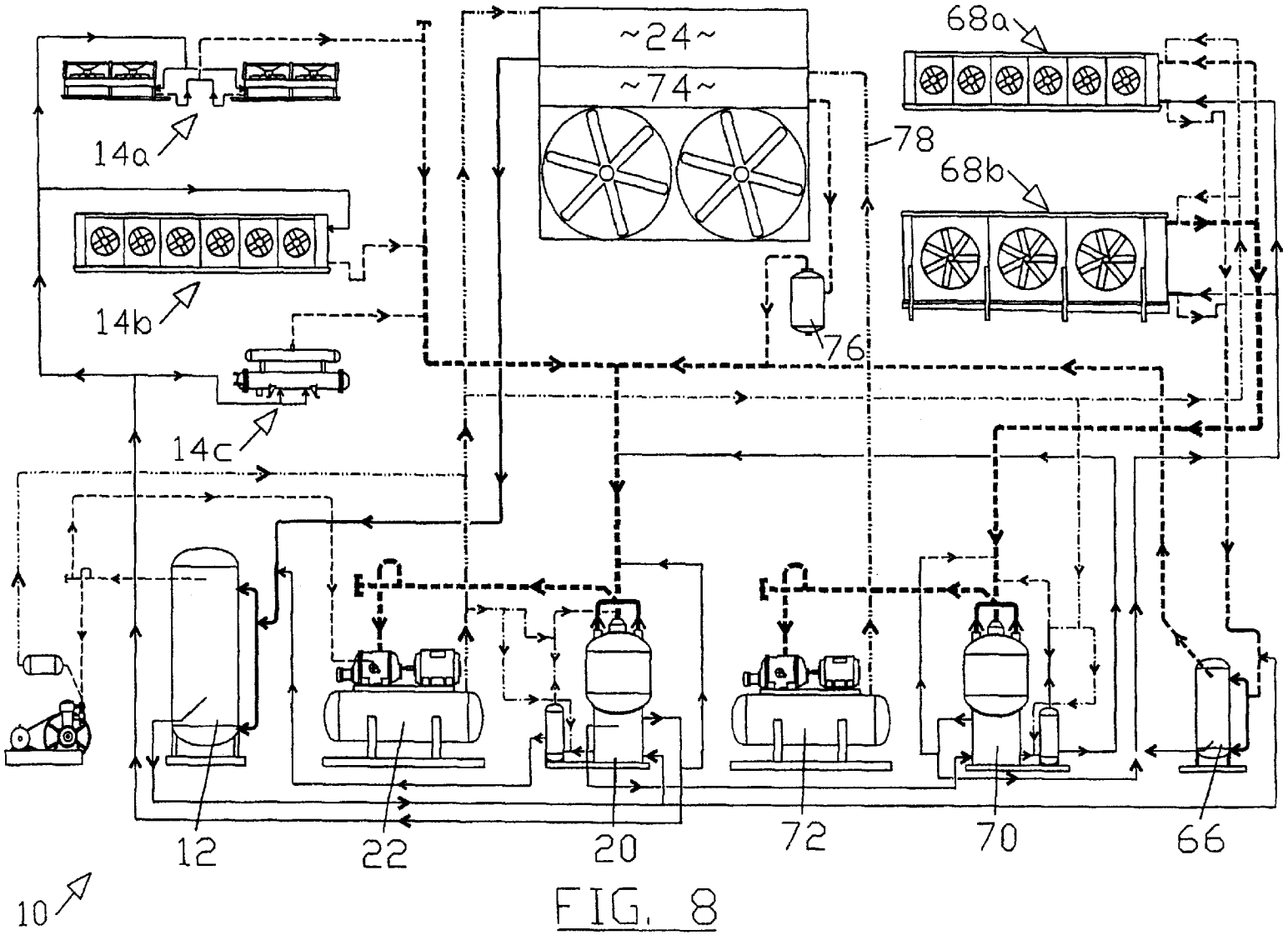
FIG. 8 is a detailed schematic view of a two stage refrigeration system.

FIG. 8 is similar to FIG. 7, but utilizes component designations for the various boxes in the flow diagram of FIG. 7. This dual stage refrigeration system utilizes a high temperature stage for things such as processing units, cooler units, and chillers, and a low temperature stage for evaporators, such as blast freezers, where a very low temperature is desired. Beginning with the high stage compressor, ammonia gas is pumped from the high stage accumulator 20 to the condenser 24. At the condenser 24, water and air are used to condense the ammonia gas back to a liquid. The liquid is pushed down to control pressure receiver 12, which pushes the liquid through the plant to the various evaporators 14*a,* 14*b,* and 14*c.* At each evaporator 14*a,* 14*b,* and 14*c,* an electronic expansion valve is utilized to meter the flow of liquid to the exact proportions needed to do maximum cooling, without over feeding and causing liquid carryover. For extremely low temperature applications, such as a blast freezer where a temperature of 0° F. or lower is desired, the ammonia liquid is pushed from receiver 12 to a low temperature low pressure receiver 66. Receivers 12 and 66 take the majority of the "flash" out of liquid ammonia, thereby making evaporators 14*a,* 14*b,* and 14*c* and low temperatures evaporators 68*a* and 68*b,* more efficient. "Flash" has been a major problem for ammonia refrigeration systems, and has been known to cause an evaporator coil to lose as much as 10 percent of its capacity. The refrigeration system 10 greatly reduces this problem, and uses the pressure of the receivers to "pump" the liquid. This pressure is typically equal to the pressure a modern liquid ammonia pump would output, so that the efficiency of the "pumping" would not be compromised compared to the conventional liquid pumps.

Once the liquid ammonia is evaporated in the various evaporators 14*a,* 14*b,* 14*c,* 68*a* and 68*b,* the ammonia gas is motivated back to the high stage accumulator 20 from evaporators 14*a,* 14*b,* and 14*c,* and to low stage accumulator 70 from low temperature evaporators 68*a* and 68*b,* respectively. Once in accumulators 20 and 70, the gas is simply suctioned back into the associated compressors 22 and 72, respectively.

Figure 9:
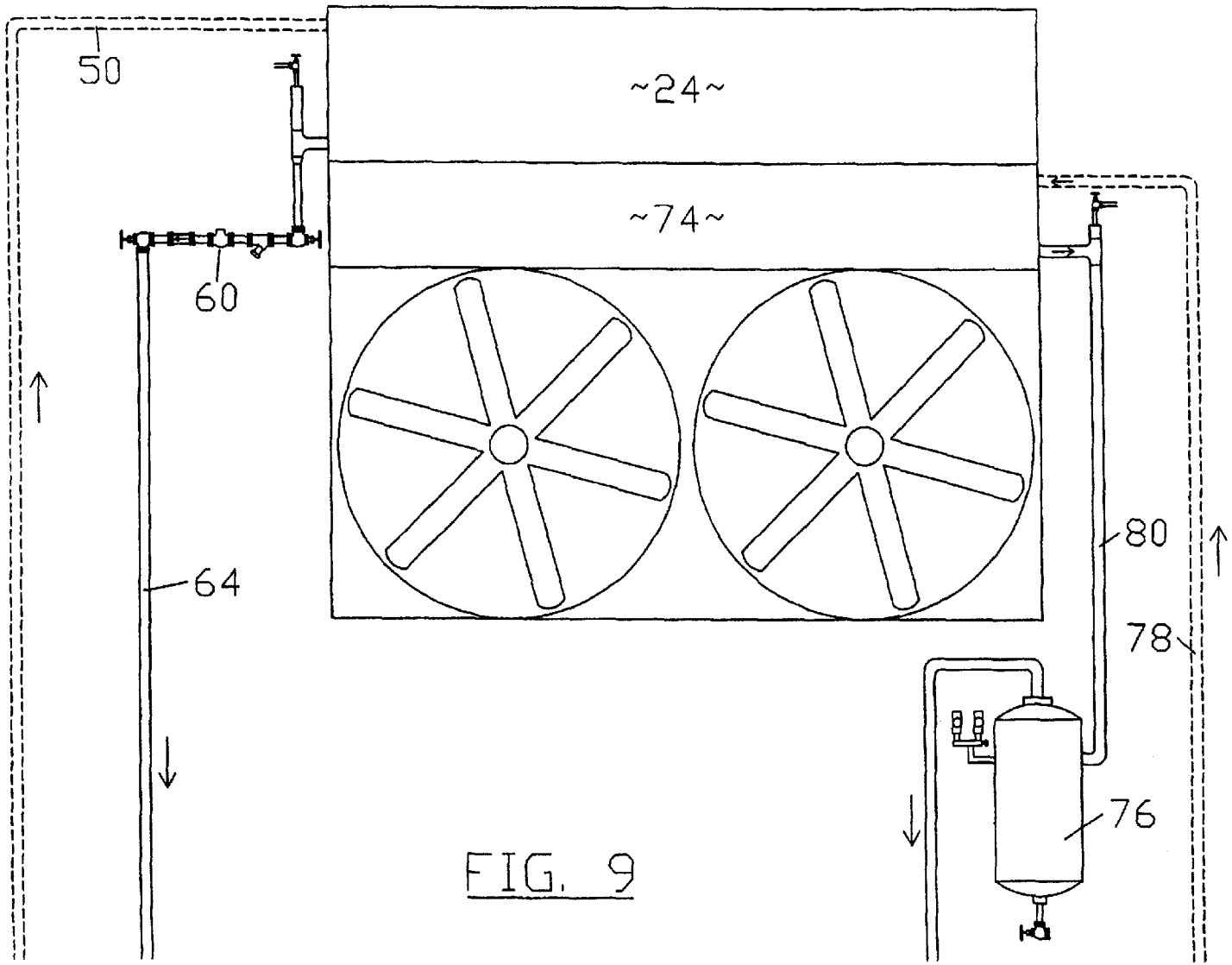
FIG. 9 is an enlarged schematic view of the two stage system condenser showing the desuperheating coil of the present invention.

Referring now to FIG. 9, condenser 24 in the dual stage refrigeration system, includes the standard portion 24 which condenses gas from the high stage compressors via inlet pipe 50 and returns the condensed liquid through trap 60 and pipe 64. The desuperheating coil 74 is located proximal condenser 24, and takes gas from the low stage compressor 72 (shown in FIGS. 7 and 8) via line 78, and removes heat via the desuperheating coil before the gas reaches the high stage accumulator 20. To facilitate the efficient removal of oil, an oil separator 76 may be mounted in outlet line 80 from the desuperheating coil 74.

Prior art dual stage refrigeration systems may pump high stage gas of approximately 185 psi through a coil to remove oil, and thence through a condenser. The present desuperheating coil differs significantly from this prior art in that the desuperheating coil is located after the low stage compression and prior to the high stage suction. This reduction of heat in the gas requires less horsepower for the high stage compressor to compress the gas from 30 psi to 185 psi, thereby extending the life of the compressor and increasing the efficiency of the system.

Whereas the invention has been shown and described in connection with the preferred embodiment thereof, many modifications, substitutions and additions may be made which are within the intended broad scope of the appended claims.

We claim:

1. A two-stage refrigeration system, comprising:

a high stage evaporator fed with liquid refrigerant and discharging a vapor refrigerant;

a high stage compressor receiving vapor refrigerant from the high stage accumulator, for compressing the vapor refrigerant;

a high stage condenser receiving compressed vapor refrigerant from the high stage compressor, for condensing it into liquid refrigerant;

a controlled pressure receiver receiving the liquid refrigerant from the high stage condenser and supplying it to the high stage evaporator;

a low stage receiver for receiving low temperature liquid refrigerant from the high stage accumulator, said low temperature liquid refrigerant having a lower temperature and pressure than the liquid refrigerant in the high stage, and supplying the low temperature liquid refrigerant to a low temperature evaporator;

said low temperature evaporator evaporating the low temperature liquid refrigerant and discharging a low temperature vapor refrigerant;

a low stage accumulator for accumulating low temperature vapor refrigerant discharged from the low stage evaporator;

a low stage compressor receiving low temperature vapor refrigerant from the low stage accumulator, for compressing the low temperature vapor refrigerant and discharging compressed vapor refrigerant; and said high stage condenser including a second section for receiving and cooling the compressed low temperature vapor refrigerant and supplying it to the high stage accumulator.

* * * * *